US009896651B1

(12) United States Patent
Karim et al.

(10) Patent No.: US 9,896,651 B1
(45) Date of Patent: Feb. 20, 2018

(54) ANTISEPTIC AND FRAGRANCE-FREE SOAP

(71) Applicant: KING SAUD UNIVERSITY, Riyadh (SA)

(72) Inventors: Mohammad Rezaul Karim, Riyadh (SA); Muhammad Omer Aijaz, Riyadh (SA); Nabeel Al-Harthi, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 15/589,787

(22) Filed: May 8, 2017

(51) Int. Cl.

| | |
|---|---|
| ***C11D 9/00*** | (2006.01) |
| ***C11D 9/06*** | (2006.01) |
| ***C11D 9/18*** | (2006.01) |
| ***C11D 13/10*** | (2006.01) |
| ***C11D 13/16*** | (2006.01) |

(52) U.S. Cl.
CPC ..... *C11D 9/007* (2013.01); *C11D 9/06* (2013.01); *C11D 9/18* (2013.01); *C11D 13/10* (2013.01); *C11D 13/16* (2013.01)

(58) Field of Classification Search
None
See application file for complete search history.

(56) References Cited

U.S. PATENT DOCUMENTS

| | | | | |
|---|---|---|---|---|
| 4,115,294 | A | 9/1978 | Fearnley et al. | |
| 4,490,280 | A | 12/1984 | Joshi et al. | |
| 5,576,280 | A | 11/1996 | Chopra et al. | |
| 9,326,921 | B1 * | 5/2016 | Jeong | A61K 8/19 |
| 2007/0081958 | A1 * | 4/2007 | Bechert | A61K 8/11 424/70.1 |
| 2009/0230364 | A1 | 9/2009 | Pike-Biegunski | |
| 2010/0056485 | A1 | 3/2010 | Park | |
| 2012/0189534 | A1 | 7/2012 | Hussain et al. | |
| 2016/0022827 | A1 | 1/2016 | Chan et al. | |
| 2016/0089325 | A1 * | 3/2016 | Perkins | A61Q 9/02 424/64 |
| 2016/0376526 | A1 * | 12/2016 | Smith | C11C 1/025 508/539 |

* cited by examiner

*Primary Examiner* — Necholus Ogden, Jr.
(74) *Attorney, Agent, or Firm* — Richard C. Litman

(57) ABSTRACT

The antiseptic and fragrance-free soap includes about 5% to 30% percent by weight of deionized water, about 3% to 10% by weight of caustic soda, about 25% to 90% by weight of vegetable fat, and about 0.1% to 1% by weight of antibacterial nanoparticles. The vegetable fat can be selected from the group consisting of olive oil, coconut oil, palm oil, almond oil, jojoba oil, shea butter, or a combination thereof. The antibacterial nanoparticles are preferably silver nanoparticles made by any conventional method.

2 Claims, No Drawings

ANTISEPTIC AND FRAGRANCE-FREE SOAP

BACKGROUND OF THE INVENTION

1. Field of the Invention

The present invention relates to soap production, and particularly to an antiseptic and fragrance-free soap and method of making the same.

2. Description of the Related Art

Some components commonly found in commercial soaps, such as animal fats, synthetic additives, colorants, preservatives, chemical additives, and artificial fragrances do not comport with Halal standards. Accordingly, soaps containing such components are forbidden under Islamic principles. Further, soaps that do conform to Halal standards typically do not contain anti-bacterial properties.

Thus, an antiseptic and fragrance-free soap solving the aforementioned problems is desired.

SUMMARY OF THE INVENTION

The antiseptic and fragrance-free soap includes about 5% to 30% percent by weight of deionized water, about 3% to 10% by weight of caustic soda, about 25% to 90% by weight of vegetable fat, and about 0.1% to 1% by weight of antibacterial nanoparticles. The vegetable fat may be selected from the group consisting of olive oil, coconut oil, palm oil, almond oil, jojoba oil, shea butter, or a combination thereof. Caustic soda is commonly known as lye and has the chemical name sodium hydroxide. The antibacterial nanoparticles are preferably silver nanoparticles, and may be made by any conventionally known technique. A method of making the antiseptic and fragrance-free soap is also provided.

These and other features of the present invention will become readily apparent upon further review of the following specification.

DETAILED DESCRIPTION OF THE PREFERRED EMBODIMENTS

The antiseptic and fragrance-free soap (hereinafter referred to as the "Soap") includes about 5% to 30% percent by weight of deionized water, about 3% to 10% by weight of caustic soda (sodium hydroxide), about 25% to 90% by weight of vegetable fat, and about 0.1% to 1% by weight of antibacterial nanoparticles.

The Soap can include any suitable type of vegetable fat, such as olive oil, coconut oil, palm oil, almond oil, jojoba oil, shea butter, or a combination thereof. Further, the antibacterial nanoparticles are preferably silver nanoparticles, may be made by any conventionally known technique.

An analysis was done comparing three soap samples, including: (1) Soap made as described herein, but without anti-bacterial agents; (2) Soap made as described herein, but with anti-bacterial agents; and (3) commercial antiseptic soap in order to compare hardness (Table 1), foamability (Table 2), pH (Table 3), and the anti-bacterial properties (Table 4) between the Soap, both with and without anti-bacterial agents, as well as commercial antiseptic soap.

Example 1

Hardness Test

As illustrated in Table 1, soap hardness was tested as follows. A needle (e.g., a needle having a length of 6.4 cm and a diameter of 1 mm) was attached to a weight, such as a lead fishing weight having a mass of 150 grams, and lowered into composition (1), the Soap with anti-bacterial agents; composition (2), the Soap without anti-bacterial agents; and composition (3), the commercial antiseptic soap. The distance into which the needle penetrated the soaps after about 60 seconds was recorded to measure the hardness of each soap sample. This test was conducted three times so that the mean and the appropriate standard deviation could be computed.

TABLE 1

Hardness of the Soap Samples

| Samples | Soap without anti-bacterial agents | Soap with anti-bacterial agents | Commercial antiseptic soap |
|---|---|---|---|
| Depth of needle penetration (cm) | 0.65 cm ± 0.07 | 0.67 cm ± 0.05 | 0.65 cm ± 0.05 |

Example 2

Foamability Test

As illustrated in Table 2, soap foamability was tested by dissolving 1.00 g of each soap in 10 ml of distilled water in a 100 ml measuring cup and shaken vigorously for approximately 5 minutes. Each mixture was allowed to sit for approximately 15 minutes, after which the height of the foam was determined. This test was conducted three times so that the mean and the appropriate standard deviation could be computed.

TABLE 2

Height of Foam of Soap Samples Dissolved in Water

| Samples | Soap without anti-bacterial agents | Soap with anti-bacterial agents | Commercial antiseptic soap |
|---|---|---|---|
| Foam height (cm) | 16 cm ± 0.2 | 17.5 cm ± 0.5 | 19.5 cm ± 0.1 |

Example 3 pH Testing

As illustrated in Table 3, the pH produced by each of the soap samples was analyzed using a suitable pH meter, viz., a HANNA HI 422 pH Meter. Approximately 1.0 gram of each of the produced soaps was dissolved in approximately 50 mL of deionized water. Subsequently, the pH of each of the samples was measured using the pH meter. This test was conducted twice so that the mean could be computed.

TABLE 3

| pH of Soap Samples Dissolved in Water | | | |
|---|---|---|---|
| Samples | Soap without anti-bacterial agents | Soap with anti-bacterial agents | Commercial antiseptic soap |
| pH | 9.9 | 9.8 | 10 |

Example 4

Anti-Bacterial Testing

As illustrated in Table 4, the anti-bacterial properties were tested using a control sample, a sample having bulk anti-bacterial agents, Soap prepared as described herein without anti-bacterial agents, Soap as described herein with anti-bacterial agents, and commercial antiseptic soap. The anti-bacterial properties of the soap samples were studied using the bacteria *Escherichia coli*, obtained from the Department of Agriculture, King Saud University, Riyadh, Saudi Arabia. A colony of organisms was obtained from a slant culture of test organisms, and then suspended in sterile distilled water in a glass bottle. Subsequently, approximately 10 grams of each soap sample was weighed and dissolved in a sterile glass bottle containing 10 mL of distilled water, forming a stock solution having a concentration of 1000 mg/ml. The stock solution of the soap was then used to prepare various concentrations of each soap sample (e.g., 200 mg/mL, 400 mg/mL, and 600 mg/mL). The plates were left for about 1 hour so that the soap could diffuse into agar, which was then incubated with approximately 200 μl of *E. Coli* at about 28° C. for approximately 48 hours. The experiments were performed in duplicates, and the bacterial growth was observed by a colony counter, viz., a Stuart SC6+ colony counter.

TABLE 4

| Anti-bacterial Properties | |
|---|---|
| Samples | Results |
| Control | 100% bacterial growth |
| Soap wherein the bulk of which is anti-bacterial agents | Absolute inhibition (0% bacterial growth) |
| Soap w/o anti-bacterial agents | Good inhibition (approx. <15% bacterial growth) |
| Soap w/ anti-bacterial agents | Excellent inhibition (approx. <10% growth) |
| Commercial antiseptic soap | Good inhibition (approx. <20% bacterial growth) |

The soap having the anti-bacterial agents, of course, had the best anti-bacterial properties when compared with the remaining two soap samples.

As seen above, the pH range of the Soap is between 9 and 10. Further, there is no separation, precipitation, and perforation smells. As such, a comparison between the Soap samples and commercial antiseptic soap illustrates that the Soap described herein has a higher hardiness, lower pH, and better anti-bacterial properties than the commercial antiseptic soap.

Example 5

Process of Making Soap

To make the Soap, first measure approximately 5% to 30% by weight of deionized water in a container, such as a quart canning jar. After the appropriate amount of deionized water has been poured into the container, about 3% to 10% by weight of caustic soda is added to the deionized water to form a homogenized mixture, such as by stirring until the deionized water begins to clear, thereby forming lye for the Soap. Next, heat between 25% to 90% by weight of vegetable fats until they reach 120° F.

When both the lye and the heated vegetable fats (which are now oils) are at the correct temperature (between 95° F. and 110° F.), the vegetable fats (oils) are poured into a container, such as a mixing bowl, and the lye is slowly mixed into the vegetable fats, stirring the mixture for between 5 minutes to 10 minutes. Finally, about 0.1% to 1% by weight of antibacterial nanoparticles (silver nanoparticles; average size ~25 nm) are added to the vegetable fat-lye mixture until all the substances are homogenized, such as by stirring the substances or by mixing the substances in a blender, such as an immersion blender, for several minutes to form a soap mixture that is thick and light in color. The soap mixture is then poured into a mold and covered in plastic wrap. An old towel may be placed over the covered molds to maintain the residual heat. The Soap mixture is allowed to sit for up to twenty-four (24) hours in the residual heat to complete saponification.

It is to be understood that the present invention is not limited to the embodiments described above, but encompasses any and all embodiments within the scope of the following claims.

We claim:

1. The antiseptic and fragrance-free soap consisting of:

5% to 30% percent by weight of deionized water;

3% to 10% by weight of caustic soda;

25% to 90% by weight of vegetable fat; and 0.1% to 1% by weight of silver nanoparticles, wherein the silver nanoparticles have an average particle size of 25 nm, wherein the pH of the soap is 9.8.

2. The antiseptic and fragrance-free soap according to claim 1, wherein said at least one vegetable fat is selected from the group consisting of olive oil, coconut oil, palm oil, almond oil, jojoba oil, and shea butter.

* * * * *